United States Patent [19]

Sipla

[11] Patent Number: 4,594,048

[45] Date of Patent: Jun. 10, 1986

[54] VEHICLE LIFTING DEVICES

[76] Inventor: Vaclav A. Sipla, 189 River St., Waltham, Mass. 02154

[21] Appl. No.: 656,436

[22] Filed: Oct. 1, 1984

[51] Int. Cl.[4] ..... B66F 7/22

[52] U.S. Cl. ..... 414/678; 269/55; 414/781

[58] Field of Search ..... 414/358, 678, 778, 779, 414/781, 681; 269/55; 254/94; 280/47.12

[56] References Cited

U.S. PATENT DOCUMENTS

| | | | |
|---|---|---|---|
| 191,222 | 5/1877 | Blinn | 280/47.12 X |
| 3,674,252 | 7/1972 | Crabtree et al. | 414/678 X |

FOREIGN PATENT DOCUMENTS

| | | | |
|---|---|---|---|
| 1129868 | 9/1956 | France | 414/678 |
| 930486 | 7/1963 | United Kingdom | 414/678 |

*Primary Examiner*—Leslie J. Paperner
*Attorney, Agent, or Firm*—Schiller & Pandiscio

[57] ABSTRACT

A vehicle lifting device comprises a pair of J-shaped bearers spaced apart by a detachable tie member. The bearers are provided with mounting plates whereby the front and rear wheel hubs on one side of a vehicle may be secured to the bearers, with the arcuate portion of the bearers resting on the ground beneath the vehicle and the straight portion of the bearers near vertical. The bearers are configured to permit the vehicle to be rotated sideways through more than 90 degrees, swinging the vehicle's center of gravity past its apex and above or nearly above the straight portion of the bearers with the straight section horizontal. In this position, the vehicle is stable, with its underside conveniently situated for inspection, maintenance, or display.

1 Claim, 6 Drawing Figures

VEHICLE LIFTING DEVICES

BACKGROUND OF THE INVENTION

This invention relates to apparatus for tilting a vehicle, such as an automobile, on its side, and supporting it there so as to provide ready access to the underside of the vehicle. More particularly, this invention relates to such vehicle tilting apparatus that is sufficiently portable so as to be stored in the trunk of a car.

A variety of portable means facilitating access to the underside of vehicles for repairs and maintenance are known. For instance, crawlers, jacks, and portable ramps are commonly used to allow a mechanic to work beneath an automobile. Such means, while simple, inexpensive, and relatively portable, place the user in a crowded, inconvenient, and frequently dangerous position. The undercarriage of modern automobiles is close to the ground, and consequently, even with crawlers, jacks, and ramps, access is inconvenient and somewhat difficult, the mechanic being forced to hunch his way beneath the car on his back. Moreover, crawlers and jacks require the worker to assume a supine position below and close to the work, with the consequence that dirt, fluids, welding sparks, and the like, falling from the work will fall onto the worker or into the worker's eyes. Jacks and portable ramps offer an additional hazard, particularly for the hobbyist, who might improperly use them to secure working clearance under a low-slung automobile. Further, if jacks or ramps are used to secure clearance, the car may be raised so high as to prevent simultaneous access to the car from above. Thus, engine work might require repeatedly lifting and lowering the car to gain access to the engine alternately from above and below.

As an alternative approach, it is also known that a vehicle may be tilted onto its side by a portable arcuate cradle attached to the vehicle. For instance, as shown in U.S. Pat. No. 3,674,252, such a cradle includes means to mount the cradle to the wheel mounting hubs of the front and rear wheels on one side of the vehicle and also includes orthogonal adjustable supports for contacting the vehicle in order to support and stabilize it on the cradle. The cradle is also provided with one or more saftey legs to secure the cradle and the attached vehicle in its tilted position. The safe use of such a cradle requires the adjustment of a number of stabilizing supports and also requires the installation, after the vehicle is tilted, of at least one saftey leg under the tilted vehicle. Improper adjustment of the supports may result in a dangerous or damaging shifting of the vehicle on the cradle during use, while improper installation of the saftey legs clearly subjects the user to grave danger. It might also be noted that the installation of the saftey legs under a tilted vehicle is in itself a dangerous operation.

OBJECTS OF THE INVENTION

Accordingly, it is an object of the present invention to provide a simple, inexpensive, easy to use, and portable apparatus that permits ready access to the underside of a vehicle without requiring the user to assume a supine position under the vehicle.

It is an additional object of the invention to provide relatively safe and convenient access to the underside of a vehicle.

Further, it is an object of the present invention to provide such an apparatus that permits simultaneous access to both the underside and the top of the vehicle.

Additionally, it is an object of the present invention to provide a simple, inexpensive apparatus that permits the display of the undercarriage of a vehicle for exhibition purposes.

It is also an object of the present invention to provide a simple to use, portable, and safe apparatus for tilting a vehicle on its side.

BRIEF DESCRIPTION OF THE INVENTION

These and other objects are met in the present invention of a vehicle lifting device comprising a pair of J-shaped bearers adapted to be secured to the front and a rear wheels on one side of the vehicle and a detachable tie member adapted to attach the bearers together.

To use the invention, the vehicle is first jacked-up to permit the removal of a front and rear wheel on the same side. The J-shaped bearers are positioned opposite the wheels, with the arcuate portions of the bearers resting on the ground beneath the vehicle and the straight sections substantially vertical. The bearers are attached to the wheels and connected together by the detachable tie member. The vehicle is now tilted sideways, permitting access to the underside of the vehicle.

Inmportantly, the bearers are configured to permit the vehicle to be rotated through more than 90 degrees. This swings the center of gravity of the vehicle past its apex and above or nearly above the straight sections of the bearers. Thus, with the vehicle fully tilted so that the straight sections of the bearers rest on the ground, the vehicle will automatically be in a stable position. In this position, the undercarraige is available for display, inspection, or maintenance from the side, as is the top of the vehicle.

Other objects of the invention will in part be obvious and will in part appear hereinafter. The invention accordingly comprises the apparatus possesing the construction, combination of elements, and arrangement of parts which are exemplified in the following detailed disclsure, and the scope of the application of which will be indicated in the claims.

BRIEF DESCRIPTION OF THE DRAWINGS

For a fuller understanding of the nature and objects of the present invention, reference should be had to the following detailed description taken in combination with the accompanying drawings wherein.

In all of the views, similar index numbers refer to like elements.

DETAILED DESCRIPTION OF THE INVENTION

Figure 1:
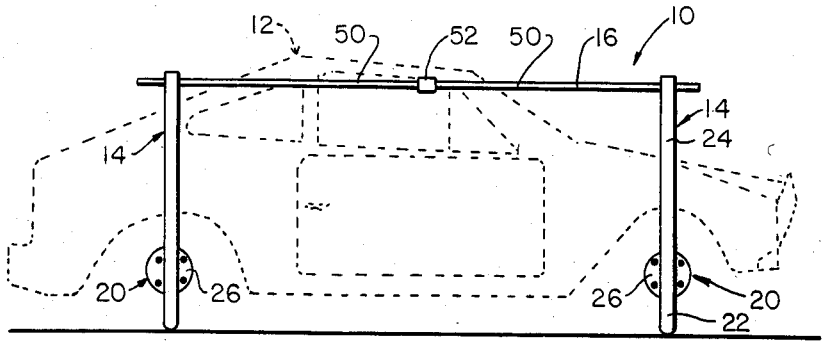
FIG. 1 is a view, from the side, of the present invention attached to an automobile, with the latter in the upright position.

Referring to FIG. 1, there may be seen a preferred embodiment of the present invention in the form of an automobile lifting device 10, shown secured to an automobile 12. Lifting device 10 comprises a pair of bearers 14 and a tie member 16. As will become apparent, the dimensions of the various parts of the device will vary depending on the vehicle, and in the description that follows dimensions are given for a preferred embodiment intended for use with a small or medium sized automobile.

Figure 4:
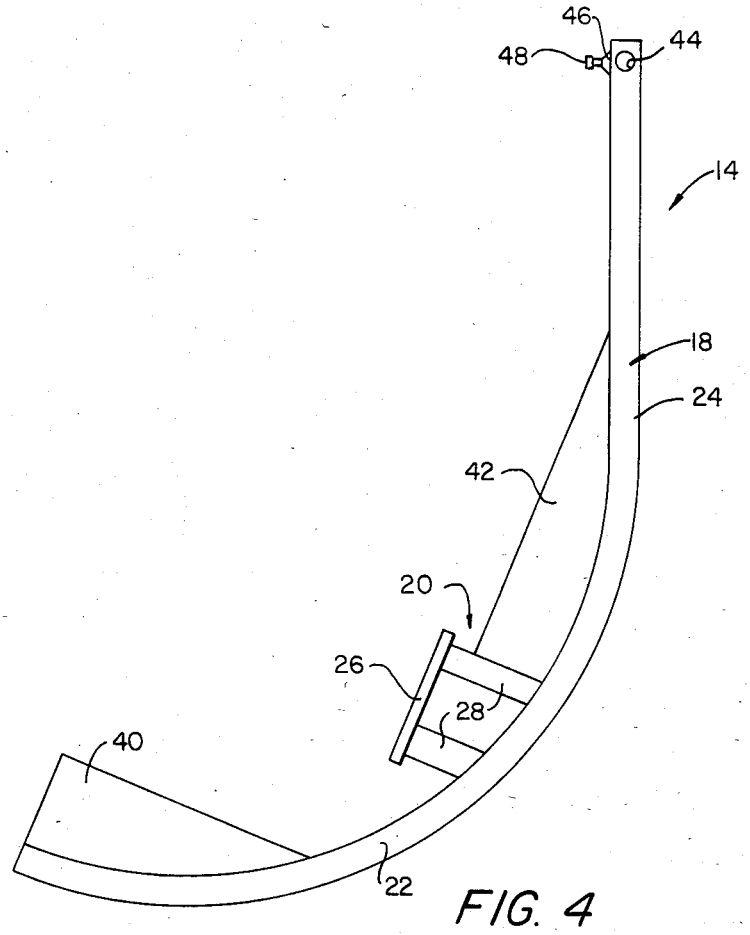
FIG. 4 is a detailed view of the structure of one of the J-shaped bearers of the present invention, as would be seen if viewed from the rear of the vehicle in FIGS. 1 through 3.

In greater detail, each bearer 14 comprises a J-shaped rocker arm 18 and a wheel mounting structure 20 (FIG. 4). Rocker arm 18 is provided with an arcuate section 22 and a straight section 24. Preferably, arcuate section 22 is substantially a segment of a circle having a radius on the order of 26 inches (66 cm). An important feature of the invention is that arcuate section 22 subtend an angle in excess of 90 degrees. In the preferred embodiment, arcuate section 22 covers and arc on the order of 95 degrees. Straight section 24 adjoins and is continuous with arcuate section 22, being tangent to the arcuate section at the joint. In the preferred embodiment, rocker arm 18 is fabricated from a single 68 inch (174 cm) length of 1½ inch (3.8 cm) steel pipe, bent to shape. As a consequence, straight section 24 is on the order of 25 inches (65 cm) in length and arcuate section 22 covers about 43 inches (109 cm) of arc.

Figure 6:
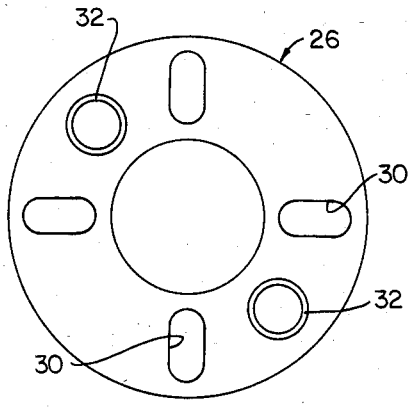
FIG. 6 is a view of a wheel mounting plate as would be used for a vehicle having a wheel secured by four bolts.

Wheel mounting structure 20 comprises mounting plate 26 and posts 28. As may be seen by reference to FIG. 6, mounting plate 26 is a substantially flat centrally apertured circular plate provided with a plurality of radial slots 30 and a pair of countersunk mounting apertures 32. Plate 26 and radial slots 30 are configured and dimensioned to accept the wheel bolts of the particular vehicle lifting device 10 is intended to be used with. While the mounting plate 26 illustrated is configured for a four-bolted wheel, it will be understood that similar mounting plates, configured for other wheel mounting arrangements (e.g., five- or six-bolted wheels) might be provided. Countersunk apertures 32 are provided in mounting plate 26 to permit connection to posts 28, as will be described. In the preferred embodiment, wheel mounting plate 26 is fabricated from ⅜ inch (1 cm) steel plate.

Figure 5:
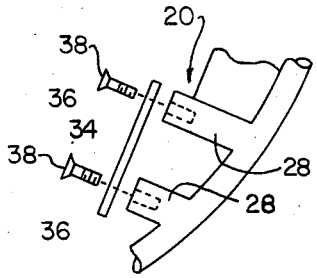
FIG. 5 is a view of a portion of FIG. 4 showing a preferred method of securing a wheel mounting plate to a bearer.

Referring to FIGS. 4 and 5, it may be seen that posts 28 are short posts attached to the concave side of arcuate section 22 so as to lie substantially in the plane of the circular arc defining the arcuate section. Posts 28 are affixed, as by welding, to arcuate section 22 near straight section 24, and are inclined toward the straight section, making an angle with the normal to the straight section that is substantially the same as the angle by which the arc of arcuate section 22 exceeds a right angle (i.e., for the preferred embodiment, 5 degrees). Posts 28 are of unequal lengths, the ends of the posts distal arcuate section 22 being finished off substantially coplanar and normal to the posts. In a preferred embodiment, posts 28 are fabricated from 1 inch (c. 2.5 cm) pipe, and the end of each post 28 is provided with a plug 34 (FIG. 5) having a central tapped bore 36. Posts 28 are spaced apart, center-to-center, by a distance less than the outside diameter of plate 26 but greater than the diameter of the central aperture of the plate. Countersunk apertures 32 of plate 26 are spaced center-to-center the same distance. A pair of chamferred flat headed bolts 38, matching tapped bores 36 and dimensioned to fit countersunk apertures 32, secure plate 26 to posts 28. Posts 28 are disposed along bearer 14 so as to position the normal to the center of plate 26 a distance from the tangent at the free end of arcuate section 22 (i.e., the end of the arcuate section distal from straight section 24) by a distance in excess of the height of the axle of the vehicle and at a sufficient distance from the rocker arm as to provide clearance between the side of the vehicle and the rocker arm when plate 26 is attached to the wheel hub of the vehicle. In the preferred embodiment, posts 28 are affixed to the rocker arm so as to position the normal through the center of wheel mounting plate 26 some 13 inches (33 cm) from the tangent to the free end of arcuate section 22 with the plate spaced some 12 inches (30 cm) from the radius to the free end of the arcuate section.

Affixed to the concave side of each rocker arm 18 and substantially in the plane of the curve defining arcuate section 22 are a pair of flat reinforcing plates 40 and 42 (FIG. 4). In the preferred embodiment, reinforcing plates 40 and 42 are ¼ inch (0.6 cm) steel plates welded to the rocker arm. Plate 40 extends from the end of arcuate section 22 distal straight section 24 to the vicinity of the intersection of the plane of plate 26 and arcuate section 22. Reinforcing plate 42 is extends from (and is affixed to) the post 28 nearest straight section 24 and extends to the straight section.

Distal arcuate section 22, each straight section 24 is provided with a circular bore 44 pentrating through the rocker arm and substantially normal to the plane of the curve defining the arcuate section. Circular bores 44 are dimensioned to accept tie member 16, which, in the preferred embodiment is fabricated from ½ inch (c. 1.2 cm) pipe. Aligned with and normal to each bore 44, a threaded bore 46 is provided in the inside (concave) side of the rocker arm. Each threaded bore 46 is provided with a matching lock screw 48 of a length sufficient to penetrate through the wall of the rocker arm and engage a tie member 16 situated in bore 44.

Tie member 16 (FIG. 1) is dimensioned to exceed the wheel base of the vehicle lifting device 10 is intended to be used with. In the preferred embodiment, tie member 16 is a pair of pipes 50 joined by a pipe coupling 52.

It will be understood that lifting device 10 may be stored and transported disassembled, as a kit comprising a pair of bearers 14 and a tie member 16. For storage in a smaller space, even tie member 16 may be disassembled into a pair of substantially equal length pipes 50 by uncoupling one pipe from the other at coupling 52, and by removing wheel mounting plates 26. In disassembled form, a preferred embodiment of lifting device 10 intended for use with automobiles stores in a volume smaller than about 5 feet by 2 feet by ½ foot (155 cm by 61 cm by 15 cm) and weighs under 60 pounds (27 kg). As such, it may be easily transported in the trunk of a conventional automobile.

Lifting device 10 is assembled by connecting pipes 50 to one another by coupling 52 and attaching bearers 14 to opposite ends of the so-assembled tie member 16. To accomplish this later assembly, each bore 44 of a bearer 50 is slipped over an end of tie member 16 with the concave sides of both bearers facing in the same direction, with arcuate sections 22 substantially coaxial, and with the bearers spaced apart by approximately the wheel base of the vehicle. Lock screws 48 are now tightened, temporarily securing bearers 14 to tie member 16. As will now be described, it is most convenient to attach each bearer 50 to a wheel of the vehicle before assembling the lifting device, and then attach tie member 16 to the bearers.

Figure 2:
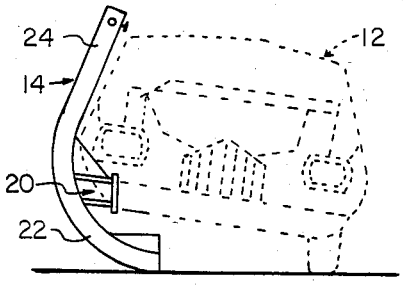
FIG. 2 is a view, from the front of the vehicle, of the present invention attached to an automobile as in FIG. 1.

Lifting device 10 is intended for use on level ground. As a preparatory step to the use of the device, it may be necessary or desirable to remove the battery, as well as any loose material from the interior of the automobile. It is also necessary in certain model automobiles to seal or drain certain fluid systems. Then one side of automobile 12 is lifted, as with a body jack (not shown), to raise the wheels on that side clear of the ground in order that the wheels may be removed. The front and rear wheels are removed, and a bearer 14 is attached to each wheel hub. To accomplish this, a bearer is positioned next to a wheel hub with arcuate section 22 of the bearer concave towards the automobile and with straight section 24 above the arcuate section and substantially vertical. Wheel mounting plate 26 of the bearer is positioned in confronting relationship to the wheel hub, and the wheel hub is manuevered so as to bring the wheel mounting bolts into alignment with the set of radial slots 30 in the wheel mounting plate. It will be appreciated that this manuever may require both a rotation of the wheel hub and a raising of the vehicle (via the jack). The mounting plate is now secured to the wheel hub by the wheel mounting bolts, passing through slots 30, and the nuts that were used to secure the removed wheel. The remaining bearer 14 is similarly secured to the other wheel hub. With both wheel hubs secured to the bearers, tie member 16 is secured to the bearers, as already described. Then the automobile is lowered, on the jack, until both bearers rest on the ground, under the respective axles, as illustrated in FIGS. 1 and 2. The jack is now removed.

Figure 3:
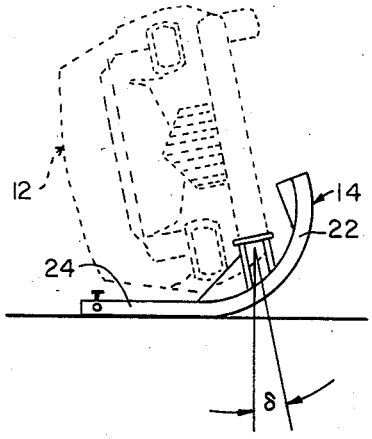
FIG. 3 is a view, from the front of the vehicle, of the automobile tilted onto its side for display, inspection, or maintenance.

The side of the vehicle distal from lifting device 14 may now be raised, either manually or mechanically. As this occurs, lifting device 14 rolls away from the lifted side on the convex sides of arcuate sections 22. This tilting motion of the vehicle may be continued until bearers 14 finally roll onto straight sections 24. Inasmuch as arcuate section 22 subtends an arc greater than 90 degrees, the vehicle may thus be tilted through an angle greater than 90 degrees. The center of gravity of the vehicle may thus be made to pass through an apex and come to rest, below its apex, above or nearly above straight sections 24. In this position, the vehicle is in a stable position on its side, with the underside of the vehicle positioned in a nearly vertical plane (FIG. 3). Both the underside and the top of the vehicle are accessable for inspection or maintenance.

To return the vehicle to its normal position, the top of the vehicle is lifted, again either by manual or mechanical means, from the upper side of the vehicle attached to lifting device 10. As bearers 14 roll onto arcuate sections 22, the vehicle rolls away from the attached side. When the wheels of the vehicle distal lifting device 14 rest on the ground, the lifting device may be removed by reversing the sequence of operations used to secure it to the vehicle (i.e., the vehicle is supported by a jack, tie member 16 is removed, wheel mounting plates 26 are detached from the wheel hubs, the wheels reattached, and the vehicle lowered to the ground).

In removing lifting device 10, it has been disassembled, and is ready for storage or transport.

It will be recognized that lifting device 10 has a number of advantages compared to prior art devices. Thus, as it is configured to tilt the vehicle through more than 90 degrees and rest the so tilted vehicle on a straight section of bearers 14, the device automatically assumes a stable position and requires no additional security provisions to maintain the vehicle in its tilted position.

As components of the lifting device are attached to the automobile prior to the assembly of the device, the attachment of the device to the vehicle is relatively simple. Small, light weight, easy to manipulate items are attached to the individual wheels and then interconnected, in contrast to prior art devices wherein opposite ends of a large, heavy device are manuevered into position and attached. As the sole tie member of the device is situated distal from arcuate sections 22, and connected only after attachment of the bearers to the vehicle, the device may be easily used with body jack positioned to the side of the vehicle. This, too, is in contrast to prior art devices employing permanent tie members across or near arcuate structure, wherein accordingly installation or removal of the tilting device to a vehicle supported by a side-mounted body jack is made difficult or impossible.

Since the apparatus may be disassembled for storage or transport, the present device may be carried in the vehicle as a part of the vehicle's emergency service kit. Further, a single device may be easily modified to be used with different vehicles by replacing wheel mounting plates 26 to accommodate different wheel mounting arrangements and by differently spacing bearers 14 on tie member 16 to accommodate different wheel bases.

It will be understood that various changes may be made in the above described apparatus. Thus, while the preferred embodiment of the invention is fabricated primarily of pipe, it might also be formed of other material, as, e.g, small dimensioned I-beam. Then again, while the preferred embodiment is adaptable for different wheel arrangements, the device might be supplied with permanently affixed wheel mounting plates. Then, too, the adjustable attachment of tie member 16 to bearers 14 might be accomplished by other means (e.g., the tie member might be threaded into mating sockets in the bearers).

Since these and other changes may be made in the above described apparatus without departing from the scope of the invention herein involved, it is intended that all matter contained in the above description or shown in the accompanying drawings shall be interpreted in an illustrative and not in a limiting sense.

What is claimed is:

1. A vehicle lifting device for tilting a vehicle sideways and supporting said vehicle in said sideways tilt, said device comprising a pair of bearers, each of substantially identical J-shape with an arcuate section subtending an angle in excess of 90 degrees and a straight section, the convex surface of said arcuate section being designed for rolling contact with a supporting surface and the straight section being continuous with and tangent to an end of said arcuate section, said bearers each including mounting means projecting inwardly from the concave side of said arcuate section adjacent said straight section, said mounting means including means for securing said mounting means to a vehicle wheel hub so that said wheel would be inclined toward said straight section by approximately the angle by which said arcuate section exceeds 90 degrees; and a detachable tie member for connecting together the portions of said straight sections distal said arcuate sections so that said bearers are maintained substantially parallel to one another and spaced apart by a distance equivalent to the wheel base of said vehicle and so that said arcuate sections are substantially coaxial.

* * * * *